US006305173B1

(12) United States Patent
Fineblum

(10) Patent No.: US 6,305,173 B1
(45) Date of Patent: Oct. 23, 2001

(54) VORTEX CHAMBER GENERATOR FOR ABSORPTION HEAT PUMP AND SYSTEM USING SAME

(76) Inventor: Soloman S. Fineblum, 33A Christopher Dr., Stoughton, MA (US) 02072

( * ) Notice: Subject to any disclaimer, the term of this patent is extended or adjusted under 35 U.S.C. 154(b) by 0 days.

(21) Appl. No.: 08/509,151

(22) Filed: Jul. 31, 1995

(51) Int. Cl.[7] ..... F25B 9/02; F25B 15/00; F25B 33/00

(52) U.S. Cl. ..... 62/5; 62/476; 62/497

(58) Field of Search ..... 62/5, 476, 497

(56) References Cited

U.S. PATENT DOCUMENTS

| | | | | |
|---|---|---|---|---|
| 3,296,807 | * | 1/1967 | Fekete | 62/5 |
| 4,580,407 | * | 4/1986 | Aime et al. | 62/148 |
| 4,926,659 | * | 5/1990 | Christensen et al. | 62/476 |
| 5,291,668 | * | 3/1994 | Becker et al. | 34/86 |
| 5,394,937 | * | 3/1995 | Nieh | 165/156 |

* cited by examiner

*Primary Examiner*—William Doerrler

(57) ABSTRACT

The generator of an absorption heat pump is consructed in the form of a vortex chamber. The absorbent liquid solution, with a high concentration of refrigerant, is tangentially injected into a vortex chamber wherein the rotational velocity is significantly increased toward the center by reason of the conservative of rotational momentum, and as a result, pressure within the central portion of the vortex chamber is reduced such that the solution at a lower temperature than normally required in conventional absorption heat pump generators. The evolved swirling refrigerant vapor will rise and leave the first vortex chamber through a central opening to flow, in one chamber which is directly above the first vortex chamber. The swirling refrigerant vapor within the upper vortex chamber will be centrifugally decelerated and partially pressurized after which the vapor is directed to flow toward the heat pump condenser while the liquid absorbent, now with a greatly reduced refrigerant concentration, will leave from the lower vortex chamber through the tangential outlet toward the absorber or a heat recovery heat exchanger. As a result, an absorption heat pump can be energized by lower temperature waste heat energy sources.

17 Claims, 9 Drawing Sheets

VORTEX CHAMBER GENERATOR FOR ABSORPTION HEAT PUMP AND SYSTEM USING SAME

BACKGROUND

1. Field of Invention

Figure 1:
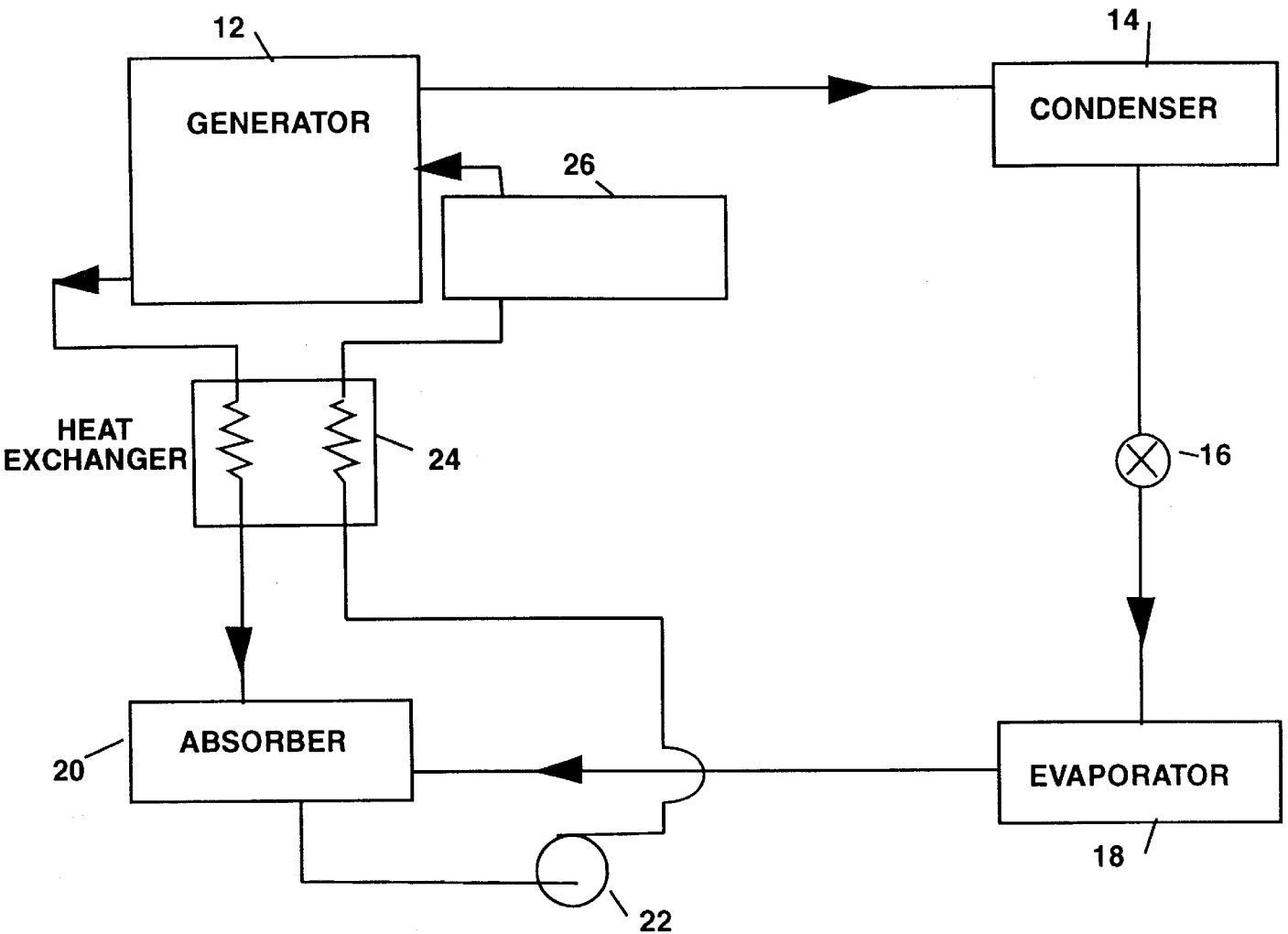

THIS INVENTION IS IN THE FIELD OF ABSORPTION HEAT PUMPS GENERALLY, AND ABSORPTION HEAT PUMP GENERATORS, IN PARTICULAR.

2. Prior Art

Preliminary search of technical and patent literature has indicated no similar approaches.

Present thermal power generating systems use various bottoming cycles to recover low temperature energy which is otherwise rejected as part of the primary cycle. Thus, the total output of all the cycles result in a greatly improved overall thermal efficiency. For instance, a heat exchanger in the high temperature, low pressure exhaust of a gas turbine engine can function as the boiler of a steam generating plant which, in turn, can energize an absorption heat pump. If this lower temperature is too low to power conventional absorption heat pumps, the energy at such a low temperature must be rejected to the ambient as a thermal waste. Cogeneration potential is often limited by the present requirement for relatively high temperatures to energize the generates of conventional absorption heat pumps. Solar energy is more efficiently collected at a lower fluid temperature which is not usefully accepted by conventional absorption systems.

The present invention avoids the disadvantage of the requirement for high temperature operation of the generator in conventional absorption heat pumps by producing a local pressure drop within the novel double vortex chamber generator which permits the generator to operate at lower temperatures as generally available with the rejected energy of many thermal systems.

Many adsorption heat pump systems suffer from crystalization if the generator temperature drops below fixed limits. These limits, however, drop with generator pressure. This problem can be prevented in conventional absorption heat pump systems by altering the absorber-absorbent solution ratio. The present invention which operates the generates at a lower pressure permits a lower temperature in the generator without the danger of crystallization and without the necessity of altering the absorber-absorbent solution ratio.

OBJECTS AND ADVANTAGES

According, several objects and advantages of the present invention are:

a. to provide an absorption heat pump generator to operate at lower temperatures than conventional absorption heat pump generators.

b. to provide an absorption heat pump generator to operate at lower temperature with less danger of crystallization.

c. to permit the operation at low generator temperature without requiring a adjustment of the absorber-absorbent solution ratio.

d. to permit the use of low temperature waste heat as the energy source for absorption heat pumps.

e. to permit the powering of absorption heat pumps by solar heat from solar collectors which can be operated to lower collector temperature and the resulting higher collector efficiency.

f. to effectively separate the liquid solution from the evolved refrigerant vapor.

Further objects and advantages of this invention will become apparent from a consideration of the ensuing description and drawings.

DRAWING FIGURES

FIG. 1 A System Schematic of Absorption Heat Pump with a Vortex Generator

Figure 2:
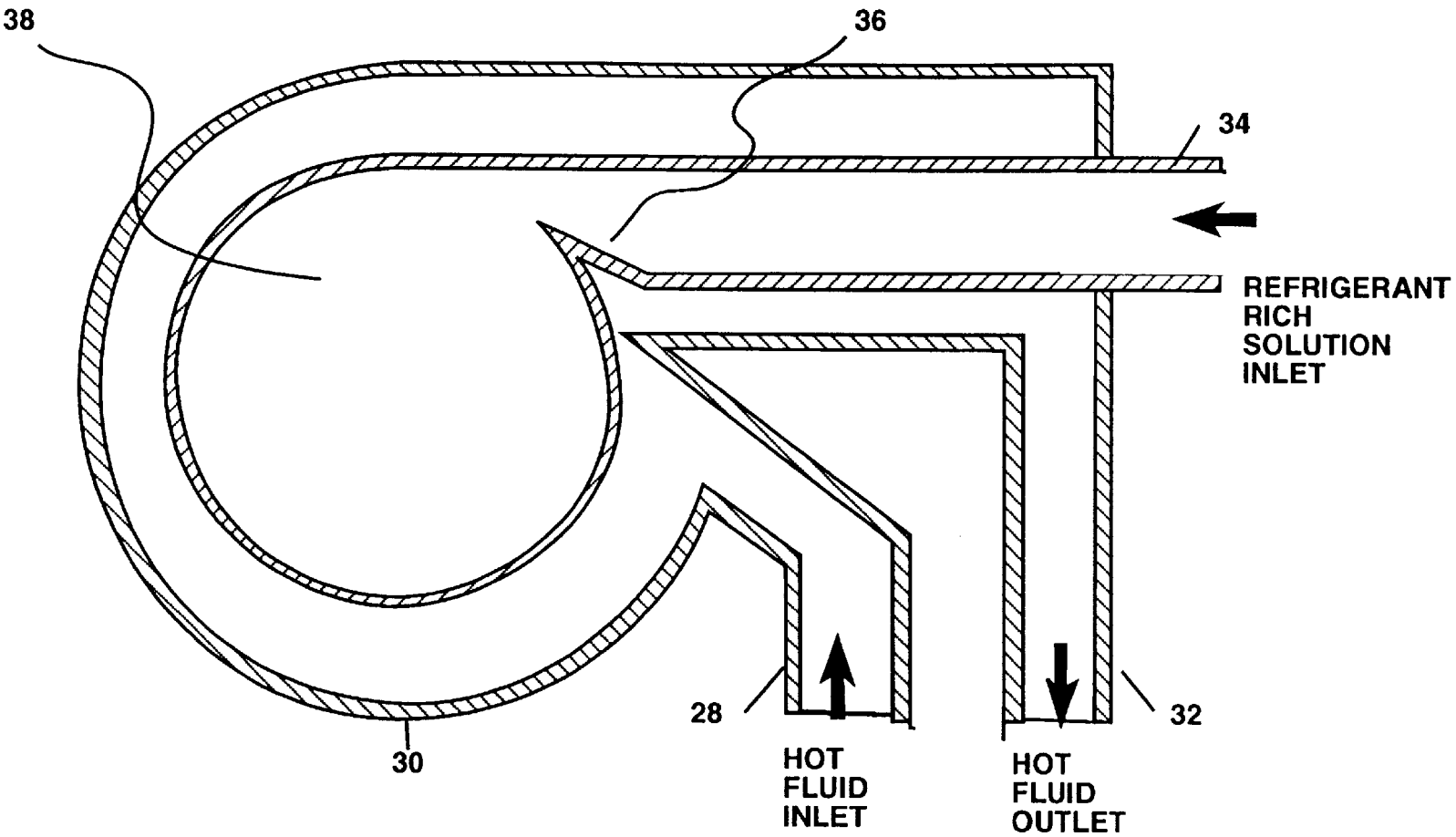

FIG. 2 A Vortex Generator with Heating Means

Figure 3:
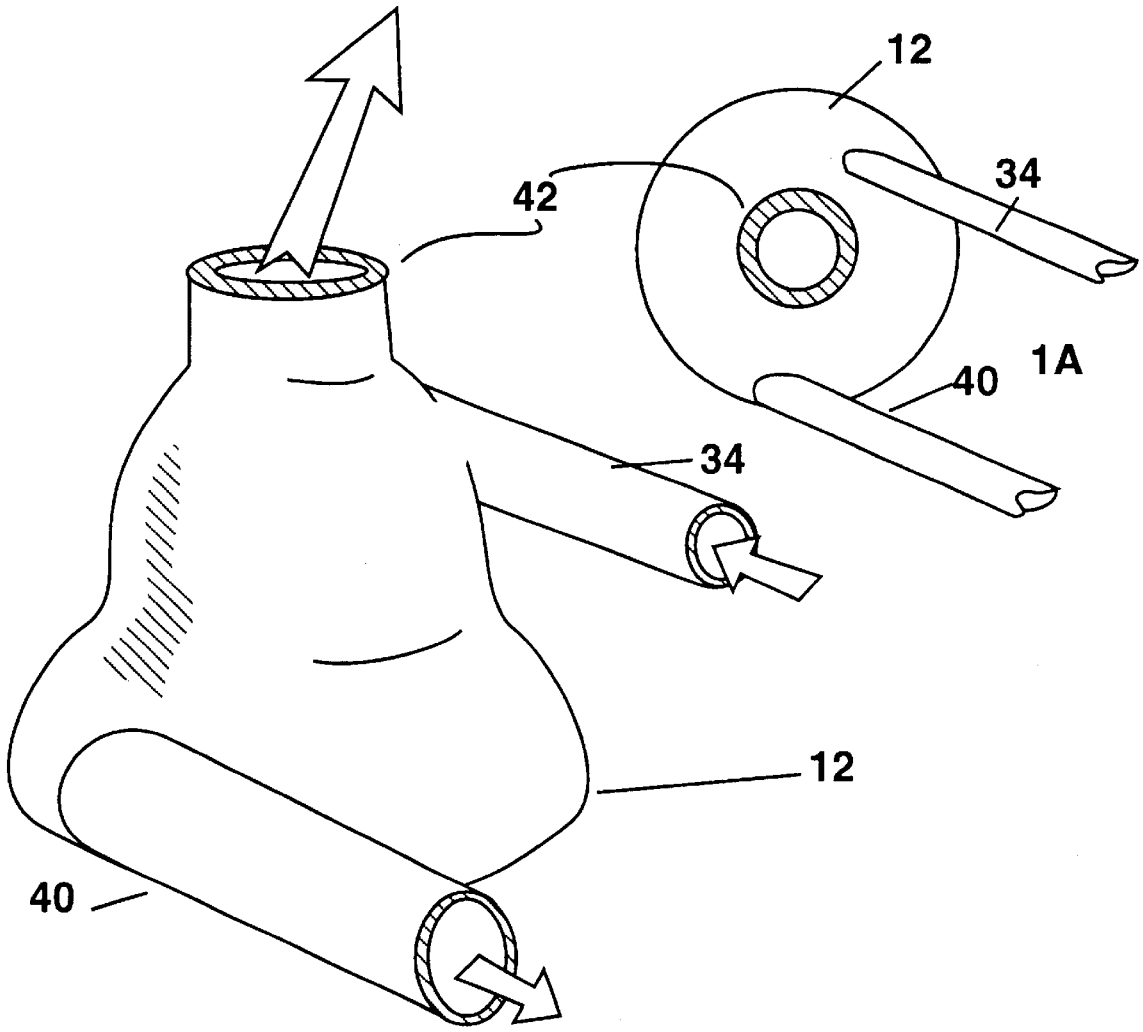

FIG. 3 A Single Chamber Vortex Generator

Figure 4:
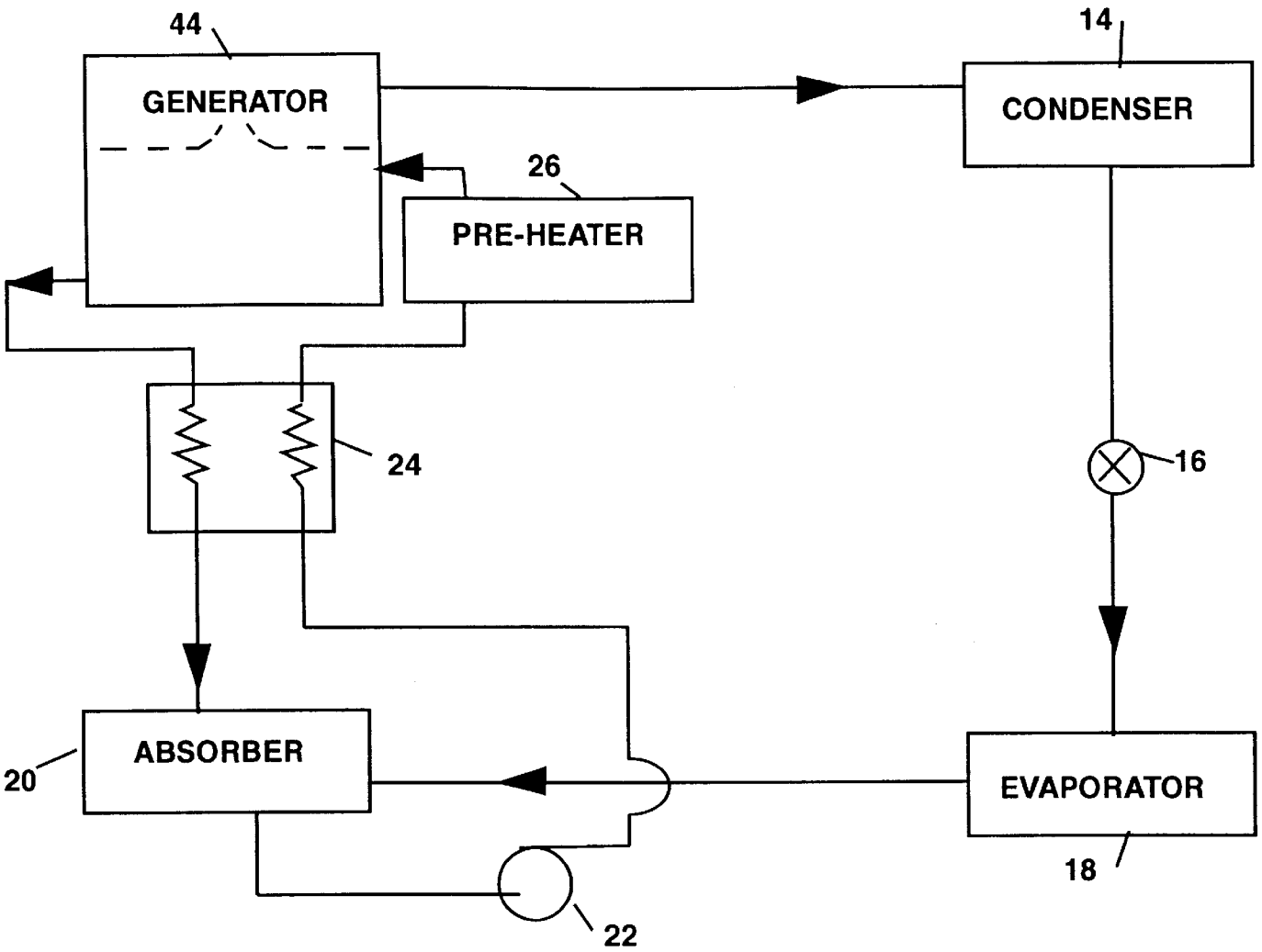
Figure 5:
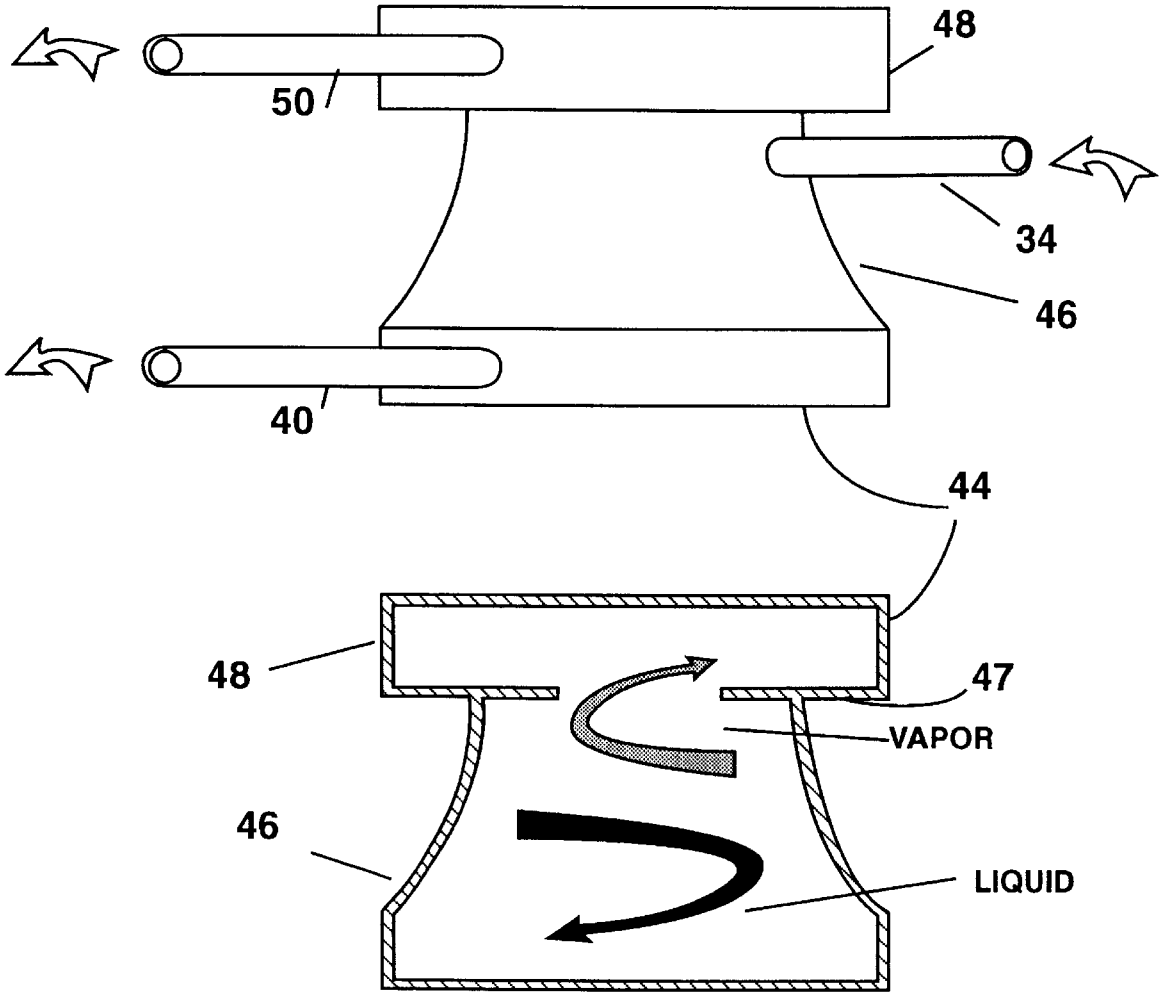
Figure 6:
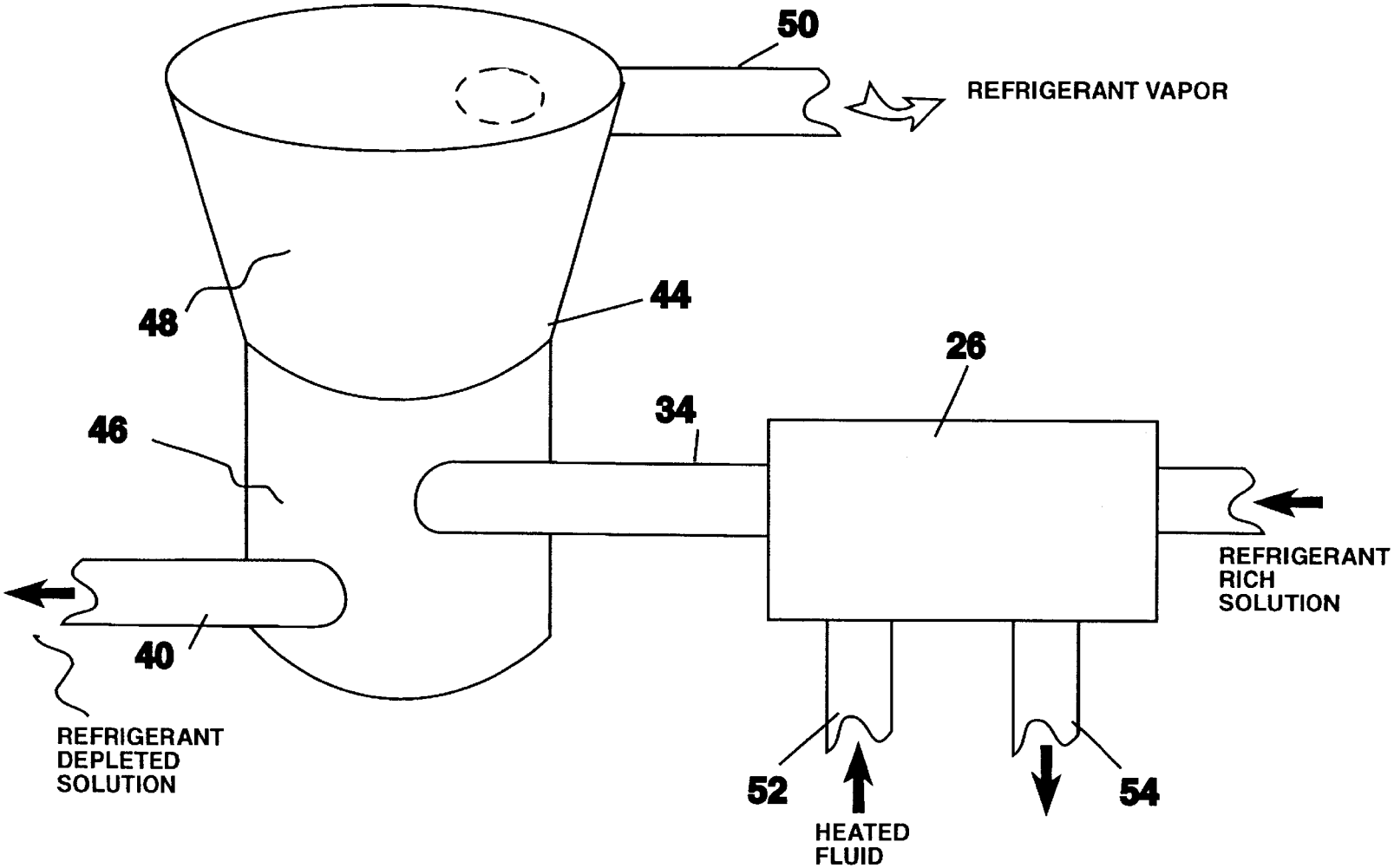
Figure 7:
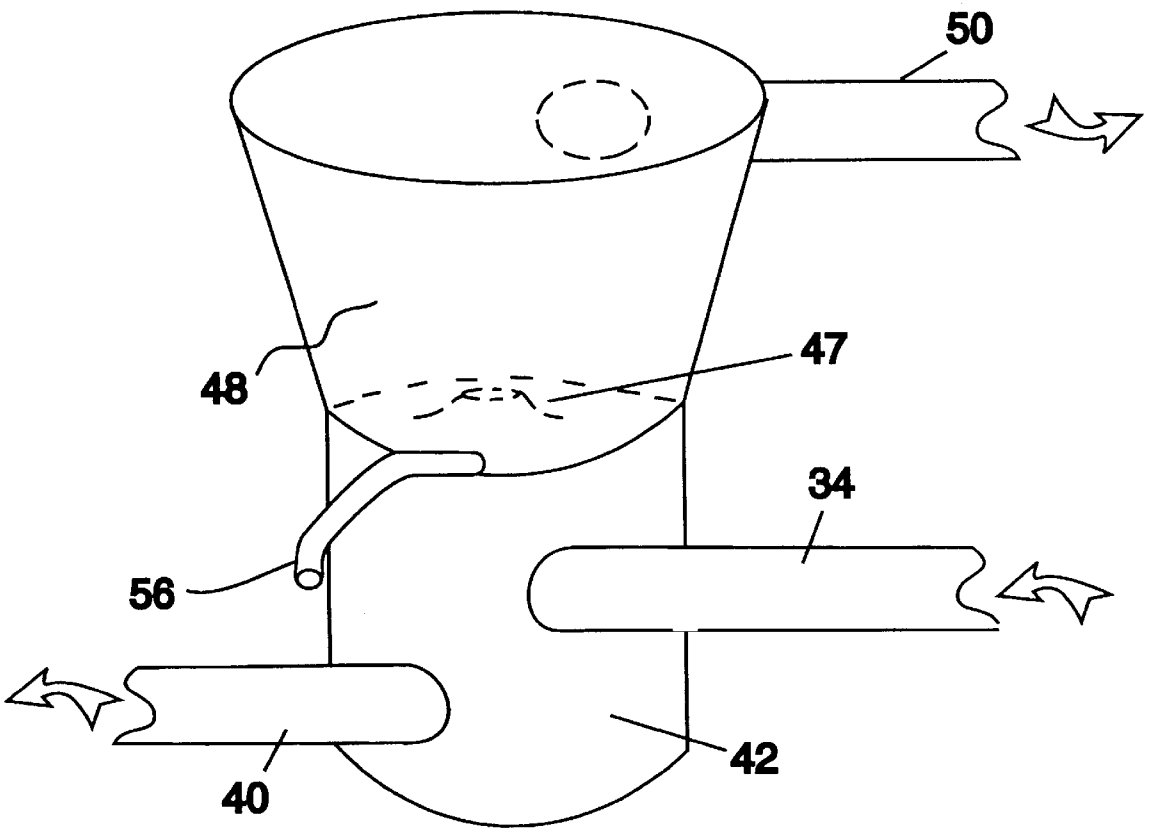
Figure 8:
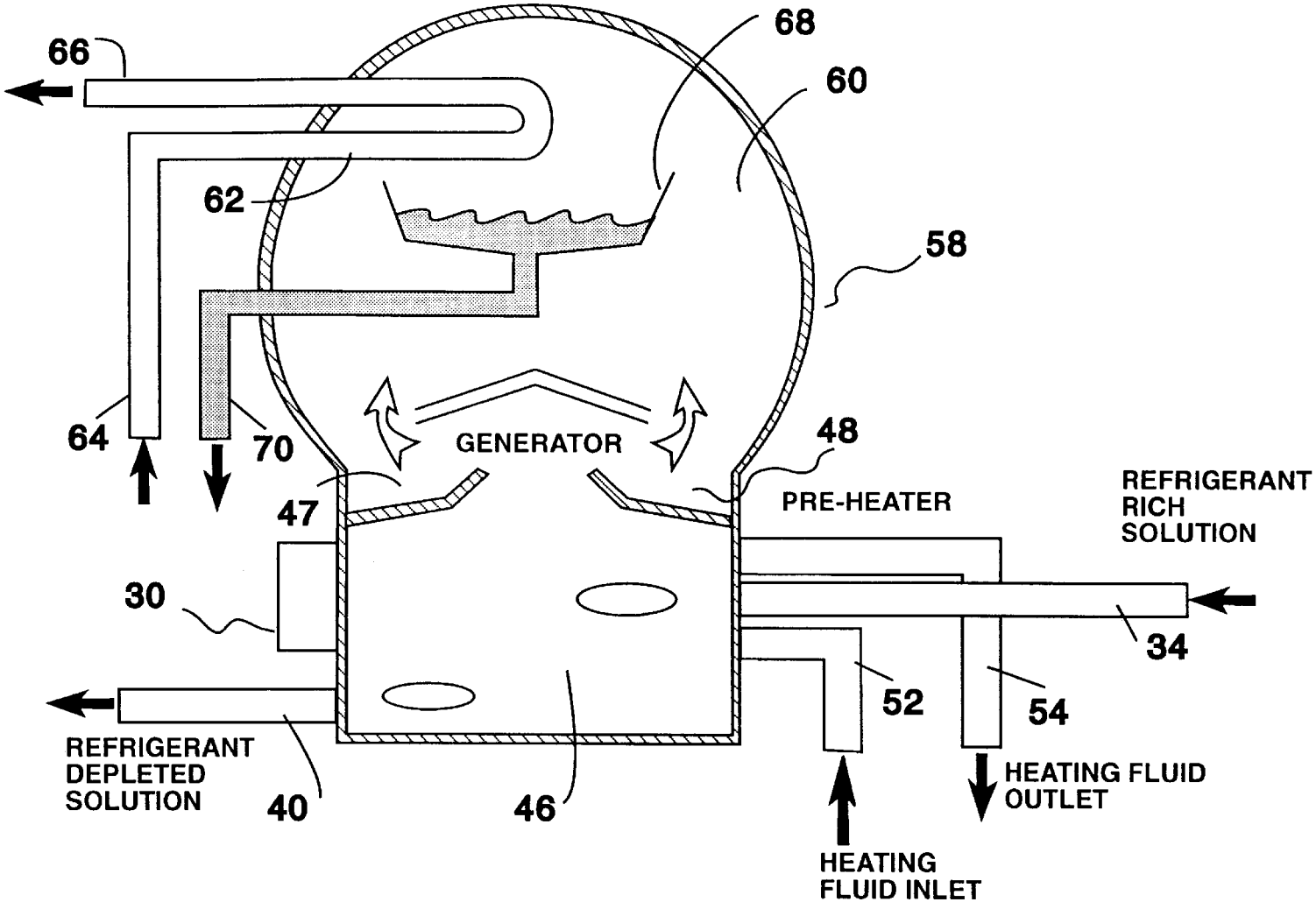

FIG. 4 A System Schematic of Absorption Heat Pump with a Double Chamber Vortex Generator FIG. 5 A Double Chamber Vortex Generator FIG. 6 A Double Chamber Vortex Generator with a Preheater FIG. 7 A Double Chamber Vortex Generator with A Solution Drain FIG. 8 A Vortex Generator With Peripheral Outlet within the Condenser.

Figure 9:
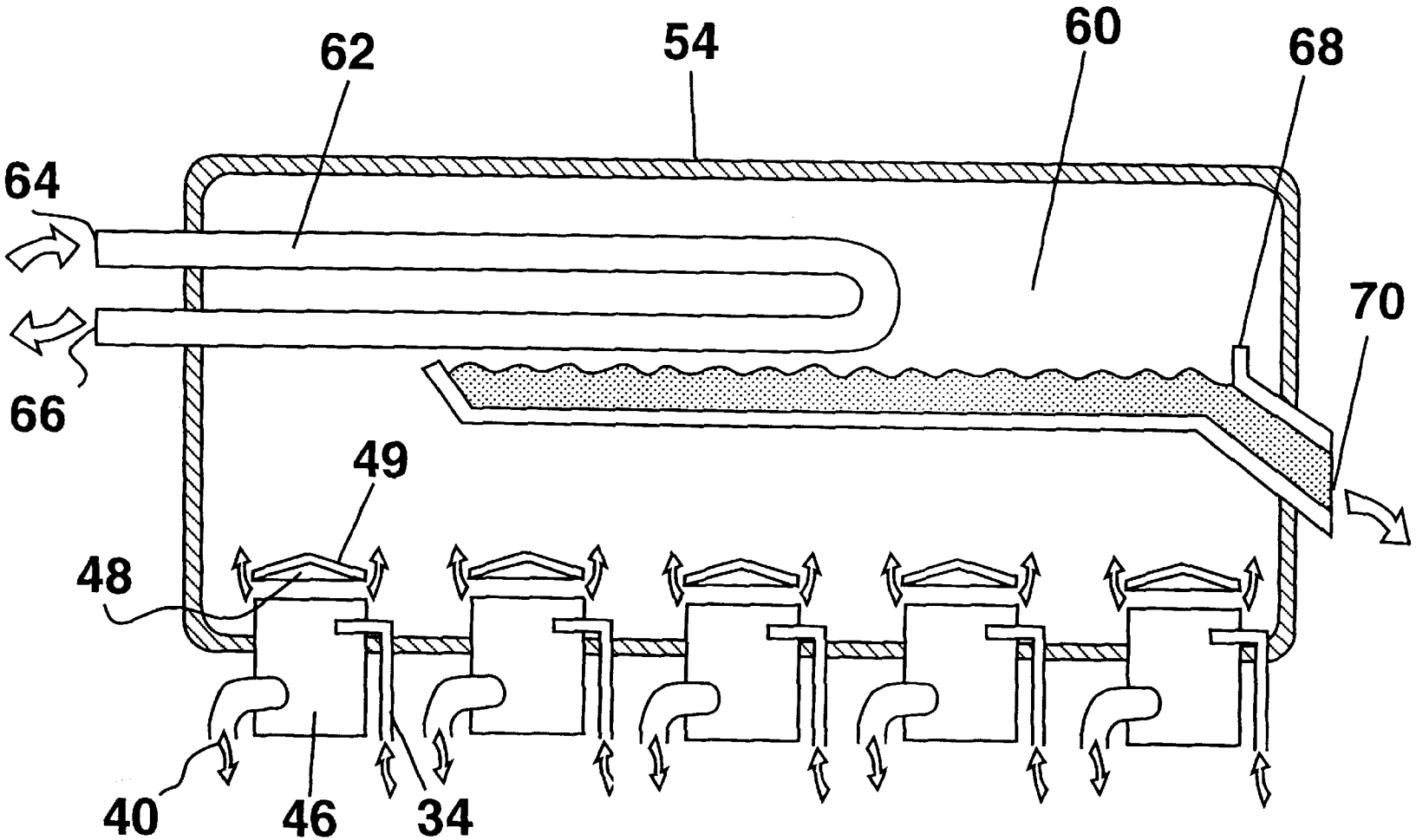

FIG. 9 An Installation of Outlet of Several Vortex Generators within one Condenser.

FIG. 1 shows a system schematic of a absorption heat pump system with a vortex generator. This system in similar to conventional systems except for the vortex generator 12 which drives the refrigerant rich solution in a tangential path such that the solution is accelerated with constant rotational momentum with a loss of pressure toward the center. As the pressure drops below the vapor pressure of the refrigerant it will evolve from the liquid solution. The vapor flows into the condenser 14 wherein it condenses. The liquid refrigerant experiences a pressure drop as it flows through an expansion valve 16 and endothermally evaporates within evaporator 18 prior to being absorbed into refrigerant depleted solution within absorber 20 to forms refrigerant rich solution which is pumped by pump 22 toward generator 26 which is downstream of regenerator 24. The solution is warmed within regenerator 24 prior to being heated in a preheater 26. The refrigerant depicted solution flows out of vortext generator 12, into warm side of regenerator 24 prior to returning to absorber 20.

FIG. 2 A Vortex Generator with Heating Means

Although the foregoing description is necessarily of a detailed character, in order than the invention may be clearly set forth, it is to be understood that the technology is not intended to be restrictive or confining and that various other arrangements of parts and modification of detail may be resorted to without departing from the spirit or scope of the invention as herein claimed.

I claim:

1. An absorption heat pump system, comprising a generator means, a heating means, a condenser means, an pressure reducing means, an evaporator means, an absorber means, a pumping means, said elements so arranged and so fluid flow connected by tubes and connections, that a refrigerant rich solution is pumped into said generator means and heated by said heating means whereby refrigerant vapor is evolved, after which the refrigerant vapor is conducted into said condenser means wherein said refrigerant in condensed and from whence liquid refrigerant flows through said pressure reduction means and evaporates within said evaporator means after which the refrigerant vapor flows into said absorber wherein the vapor is absorbed into refrigerant depicted solution which is thereby enriched prior to being pumped by said pumping means into said generator wherein refrigerant each solution is heated and deprived of a portion of refrigerant and, as refrigerant poor solution, is returned to said absorber as in conventional absorption heat pump systems, the improvement comprising said generator being in the form of a vortex chamber, said vortex chamber generator comprising a tangential inlet, a central outlet and a tangential outlet, said elements are no arranged that refrigerant rich solution enters said vortex chamber through said tangential inlet and is accelerated at constant rotational momentum with a concomitant pressure reduction below the vapor pressure of the refrigerant fraction of said refrigerant rich solution, said refrigerant traction being the most volatile portion of said solution, such that a portion of said refrigerant evolves from said refrigerant rich solution in the form of refrigerant vapor which, being lighter, floats upward and out of said vortex chamber through said central outlet and toward said condensation means as in conventional systems while refrigerant depicted solution flows out of tangential outlet toward said absorption means whereby the generation of refrigerant vapor in an absorption heat pump system occurs at a lower temperature as desired.

2. An absorption heat pump system as claimed in claim 1, wherein said vortex generator is configured in the shape of an approximate cylinder with an approximately vertical axis with said central outlet being at the upper surface of said vortex chamber and being slightly smaller in diameter than computed diameter of vapor filled void within swirling liquid, said tangential outlet being in the lower surface of said vortex chamber and said tangential inlet being placed at a height between said central outlet and said tangential outlet whereby refrigerant vapor in evolved at a lower temperature as desired and said vapor escaping through said central outlet is essentially free of liquid solution as desired.

3. An absorption heat pump system as claimed in claim 1, with a regenerator in flow path between said vortex generator and said absorber such that said refrigerant depicted solution is precooled in heat transfer contact with said refrigerant rich solution flowing from said absorber and such that said refrigerant rich solution from said absorber is preheated in heat transfer contact with said refrigerant depleted solution from said vortex generator.

4. An absorption heat pump system as claimed in claim 1, with said central outlet of said vortex generator being within said condensation means.

5. An absorption heat pump system as claimed in claim 1, with two or more of said with central outlets of said vortex generators within a single condensation means.

6. An absorption heat pump system as claimed in claim 1, with heating means in direct heat transfer contact with said vortex generator whereby refrigerant rich solution is heated as required.

7. An absorption heat pump system as claimed in claim 1, with a heat exchanger upstream of said vortex generator wherein said refrigerant rich solution is heated prior to entering said vortex generator.

8. An absorption heat pump system as claimed in claim 1 has, in addition, a rectifier downstream of said double chamber vortex generator to remove water vapor in an aqua ammonia system.

9. An absorption heat pump system, comprising a generator means, a heating means, a condenser means, an pressure reducing means, an evaporator means, an absorber means, a pumping means, said elements so arranged and so fluid flow connected by tubes and connections, that a refrigerant rich solution is pumped into said generator means and heated by said heating means whereby refrigerant vapor is evolved, after which the refrigerant vapor is conducted into said condenser means wherein said refrigerant is condensed and from whence liquid refrigerant flows through said pressure reduction means and evaporates within said evaporator means after which the refrigerant vapor flows into said absorber wherein the vapor is absorbed into the refrigerant depicted solution which is thereby enriched prior to being pumped by said pumping means into said generator wherein refrigerant rich solution is deprived of a portion of refrigerant and, as refrigerant poor solution, it is returned to said absorber as in conventional absorption heat pump systems, the improvement comprising said generator being in the form of a double chamber vortex generator, said vortex chamber generator comprising a lower vortex chamber and an upper camber, said lower vortex chamber having a tangential inlet, a central outlet and a tangential outlet, said upper vortex chamber having a central inlet and a peripheral outlet in the upper portion of said upper chamber, said elements are so arranged that refrigerant rich solution enters said lower vortex chamber through said tangential inlet and is accelerated at constant rotational momentum with a concomitant pressure reduction below the vapor pressure of the refrigerant fraction of said refrigerant solution, said refrigerant fraction being the most volatile portion of said solution, such that a portion of said refrigerant evolves from said refrigerant rich solution in the form of refrigerant vapor at a reduced temperature, and which, being lighter, flown inward and floats upward and out of said lower vortex chamber through said central outlet and into said central inlet of said upper vortex chamber wherein vapor flows outward and decelerates with a conservation of rotational momentum with concomitant recovery of some of the original pressure prior to flowing out through said peripheral outlet toward said condensation means as in conventional systems while refrigerant depleted solution flows out of tangential outlet of said lower vortex chamber toward said absorption means whereby the generation of refrigerant vapor in an absorption heat pump occurs at a lower temperature as desired.

10. An absorption heat pump system as claimed in claim 9, wherein said vortex chambers of said double chamber vortex generator are configured in the shaped of an approximate cylinder with an approximately vertical axis with said central outlet of said lower vortex chamber being at the upper surface of said lower vortex chamber and being slightly smaller in diameter than computed diameter of vapor filled void within swirling liquid solution, said tangential outlet of said lower vortex chamber being in the lower surface of said lower vortex chamber and said tangential inlet being between placed at a height between said central outlet and said tangential outlet of lower vortex chamber and said central inlet of said upper vortex chamber is directly juxtaposed upon said central outlet of said lower vortex chamber of said double chamber vortex generator, and whereby refrigerant vapor is evolved at a lower temperature as desired and refrigerant vapor flowing from said lower vortex chamber into said upper vortex chamber through said central outlet, said central outlet being properly sized, will be essential free of liquid solution as desired.

11. An absorption heat pump system as claimed in claim 9, with said peripheral outlet of said double chamber vortex generator being within said condensation means.

12. An absorption heat pump system as claimed in claim 9, with said peripheral outlets of two or more double chamber vortex generators within a single condenser chamber.

13. An absorption heat pump system as claimed in claim 9, with heating means in direct heat transfer contact with said double chamber vortex generator whereby refrigerant rich solution is heated.

14. An absorption heat pump system as claimed in claim 9, with a heat exchanger upstream of said vortex generator wherein said refrigerant rich solution is preheated prior to entering said vortex generator.

15. An absorption heat pump system as claimed in claim 9, with a regenerator in flow path between said double chamber vortex generator and said absorber such that said refrigerant depleted solution is precooled in heat transfer contact with said refrigerant rich solution flowing from said absorber and such that said refrigerant rich solution from said absorber is preheated in heat transfer contact with said refrigerant depleted solution from said double chamber vortex generator.

16. An absorption heat pump system as claimed in claim 9 has, in addition, a rectifier downstream of said double chamber vortex generator to remove water vapor in an aqua ammonia system.

17. An absorption heat pump system as claimed in claim 9 with said upper vortex chamber of said having a lower surface that slopes downward toward the periphery and a drain, one or more being effective, said drain directing liquid back into said lower vortex chamber, whereby liquid entrained in the swirling vapor entering said upper vortex chamber will drop out of the decelerating vapor and flow out of said upper vortex chamber through said rain as desired.

* * * * *